US005904194A

United States Patent [19]

Castwall et al.

[11] Patent Number: 5,904,194

[45] Date of Patent: May 18, 1999

[54] METHOD FOR PRODUCING A HARD WOOD ELEMENT

[76] Inventors: Lennart Castwall, Kanalvägen 20, S-184 41 Åkersberga; Curt Lindhe, Mårtsbovägen 20, S-777 93 Söderbärke, both of Sweden

[21] Appl. No.: 08/983,433

[22] PCT Filed: Jul. 5, 1996

[86] PCT No.: PCT/SE96/00918

§ 371 Date: Feb. 4, 1998

§ 102(e) Date: Feb. 4, 1998

[87] PCT Pub. No.: WO97/02936

PCT Pub. Date: Jan. 30, 1997

[30] Foreign Application Priority Data

Jul. 7, 1995 [SE] Sweden ..... 95002497

[51] Int. Cl.[6] ..... B27M 1/02

[52] U.S. Cl. ..... 144/361; 100/38; 100/93 P; 100/240; 144/380

[58] Field of Search ..... 100/38, 39 P, 240; 144/329, 359, 361, 380, 2.1

[56] References Cited

U.S. PATENT DOCUMENTS

| | | | |
|---|---|---|---|
| 1,403,722 | 1/1922 | Turnbull | 144/361 |
| 1,480,658 | 1/1924 | Bostock | 144/361 |
| 1,644,801 | 1/1927 | Der Werff | 144/361 |
| 4,428,410 | 1/1984 | Stanberg | 144/361 |
| 4,606,388 | 8/1986 | Favot | 144/361 |
| 5,678,618 | 10/1997 | Lindhe et al. | 144/361 |
| 5,685,353 | 11/1997 | Viitaniemi et al. | 144/361 |

FOREIGN PATENT DOCUMENTS

| | | |
|---|---|---|
| 1 522 456 | 8/1978 | United Kingdom . |
| WO 82/01504 | 5/1982 | WIPO . |
| WO 95/13908 | 5/1995 | WIPO . |

*Primary Examiner*—W. Donald Bray
*Attorney, Agent, or Firm*—Young & Thompson

[57] ABSTRACT

A method for producing hard elements from wood provides that at least one wood piece is inserted into a press together with a liquid absorbing material after which an isostatic pressure higher than 800 bar is applied on the wood piece and the liquid absorbing material, the pressure is released and the resulting hard element and the liquid absorbing material, which during the press operation has taken up liquid pressed out from the wood piece, are picked out from the press.

5 Claims, 1 Drawing Sheet

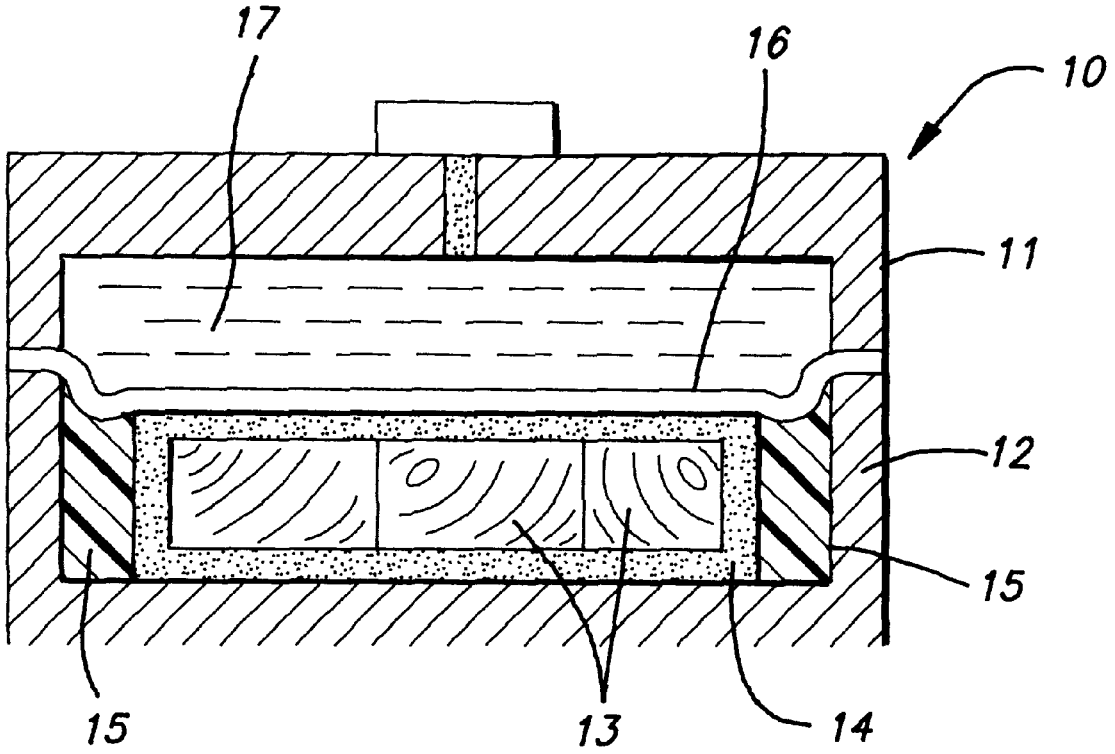
17
16
10
11
12
15
15
13
14

METHOD FOR PRODUCING A HARD WOOD ELEMENT

BACKGROUND OF THE INVENTION

This invention relates to a method for producing hard wood elements.

DESCRIPTION OF THE RELATED ART

It is previously known to produce hard wood elements by pressing wood material isostaticly at high pressure, see WO 9513908. It has however proved that it is sometimes difficult to achieve a high degree of compaction of the material depending on that the moisture content of the material is so large that the liquid, because of its non compression properties, prevent compressing.

SUMMARY OF THE INVENTION

The purpose of this invention is to rectify this shortcoming and to make it possible to achieve a high degree of compaction also when the moisture content is large.

This is achieved by means of a method having the characteristics mentioned in the claims.

DESCRIPTION OF THE PREFERRED EMBODIMENTS

An embodiment of the invention will now be described with reference to the accompanying drawing which schematically and in section shows a device for carrying out the method.

The Figure shows a so called Quintus-press 10 which is a press having an upper and a lower part 11 and 12 respectively which in a manner not shown in detail are so connected to each other that the press can take up very large press forces. The term "large press forces" in this connection means press forces larger than 10,000 tons.

On the lower press part 12 one or several wood pieces 13 are closely packed together with a liquid absorbing, porous material 14 for instance a textile material or a foamed plastic material which has the ability to absorb the liquid leaving the material during the pressing operation. The liquid absorbing material is placed close to the pieces and is preferably so placed that it at least partly surrounds the pieces. Around the pieces an elastic or plastic material 15 is placed and this material fills out the recesses in the press and transmits the pressure isostaticly to the sides of the pieces.

The upper press part comprises a rubber membrane 16 which is the lower border surface for a chamber 17 and which during the initial phase of the press operation together with the press part 11 is moved downwards towards the lower press part. The membrane 16 is thereby stretched over the material 14, 15 and will with its outer parts abut the lower press part 12.

Then a liquid enters into the chamber 17 and the liquid is exposed-to a high pressure, which in this connection means more than 800 bar. Consequently the pieces are exposed to a corresponding isostatic pressure since the membrane and the material 14,15 between the membrane and the pieces transmit the pressure equally to the pieces.

During the press operation the liquid in the pieces will be pressed out from the pieces and be absorbed by the liquid absorbing material which means that the pieces will get a higher degree of volume reduction than if the liquid stays in the pieces.

When the pressure has been released and the press parts been separated the compressed pieces, which now are hard wood elements, are picked out from the press together with the liquid absorbing material which at a later stage can be squeezed to press out the collected liquid an be reused.

We claim:

1. A method for producing hard wood elements comprising the steps of:

inserting at least one wood piece into a press;

inserting a liquid absorbing material into the press;

applying an isostatic pressure higher than 800 bar to the wood piece and the liquid absorbing material;

transforming the wood piece into a hard wood element by the liquid absorbing material taking up liquid pressed out from the wood piece under the isostatic pressure; and releasing the isostatic pressure and removing the hard wood element and the liquid absorbing material from the press.

2. The method of claim 1, comprising the further step of placing the liquid absorbing material close to the wood piece prior to the step of applying the isostatic pressure.

3. The method of claim 2, wherein said step of placing the liquid material close to the wood piece further comprises the step of at least partially surrounding the wood piece with the liquid absorbing material.

4. The method of claim 1, wherein the liquid absorbing material is a porous material.

5. The method of claim 4, wherein the porous material is one of a textile and a foamed plastic material.

* * * * *